US006301809B1

(12) United States Patent
Staggs, Jr.

(10) Patent No.: US 6,301,809 B1
(45) Date of Patent: Oct. 16, 2001

(54) MATERIAL HANDLING SYSTEM FOR POWERED DIGGING APPARATUS

(76) Inventor: Slone Staggs, Jr., HC 71, Box 197, Augusta, WV (US) 26704

( * ) Notice: Subject to any disclaimer, the term of this patent is extended or adjusted under 35 U.S.C. 154(b) by 0 days.

(21) Appl. No.: 09/604,118

(22) Filed: Jun. 26, 2000

(51) Int. Cl.[7] ..... E02F 3/40

(52) U.S. Cl. ..... 37/444; 37/445; 414/724; 414/726

(58) Field of Search ..... 37/444, 445, 406; 414/725, 722, 724, 726

(56) References Cited

U.S. PATENT DOCUMENTS 3,362,554 * 1/1968 Fortier .
3,921,837 * 11/1975 Vandewater .
4,863,338 * 9/1989 Johnson .
5,553,408 * 9/1996 Townsend .

* cited by examiner

*Primary Examiner*—H. Shackelford
(74) *Attorney, Agent, or Firm*—Dowell & Dowell, P.C.

(57) ABSTRACT

An implement for use with a bucket mounted to a dipper boom of an earth working machine wherein the implement includes bars slidable mounting within guide elements mounted to the dipper boom such that the bars may be moved by gravity from a first position spaced from the bucket to a second position in generally opposing relationship with respect to an opening in the bucket so as to facilitate the retention of materials within the bucket.

15 Claims, 13 Drawing Sheets

FIG. 3A
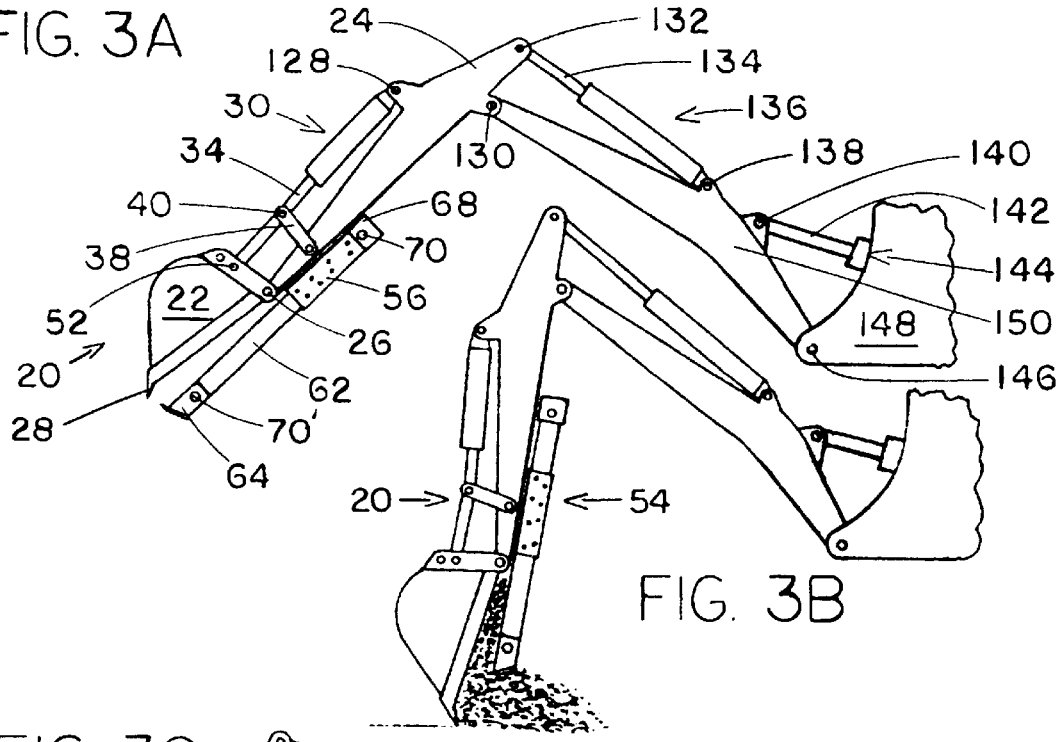
FIG. 3B
FIG. 3C
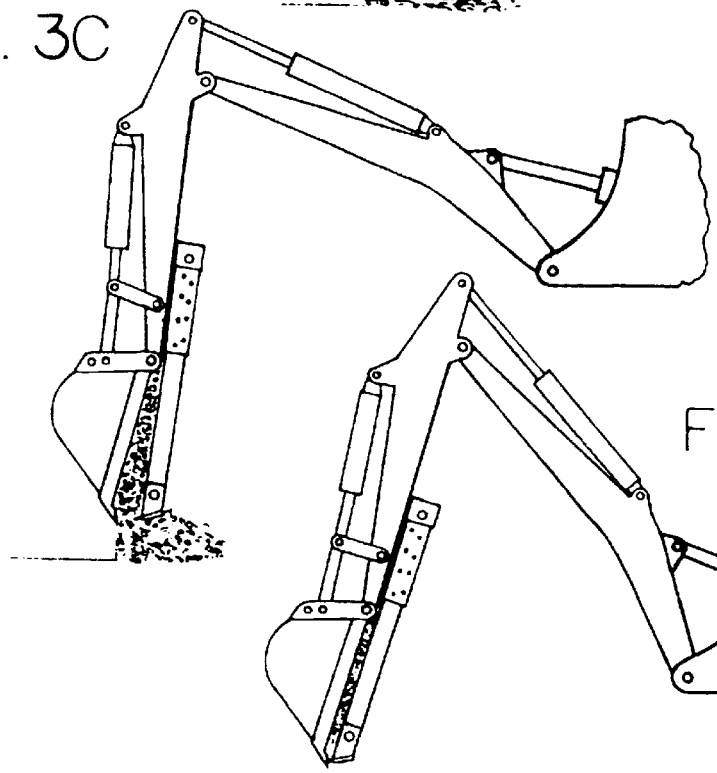
FIG. 3D

MATERIAL HANDLING SYSTEM FOR POWERED DIGGING APPARATUS

BACKGROUND OF THE INVENTION

1. Field of the Invention

This invention relates to excavating and construction equipment and more specifically to material handling systems for powered digging machines such as backhoes.

2. History of the Related Art

Backhoes have become some of the most commonly used equipment in modern industry. These machines are available in several mobile options, including track, wheel, rail, and barge mounted units. Foam filled tires, extendible dippers and side shift mounting arrangements are among the many options available for special applications.

With such a wide variety of jobs that must be done with a backhoe, it is sometimes difficult to avoid tying up a machine with specialized tools, such as log grapples and clamshell buckets, that require direct mounting to the dipper boom. Although these specialized tools work well, much time and labor are required in changing buckets and specialized tools. As a result, many machines are restricted from general use because of this disadvantage.

Several attachments are available that offer a partial solution to the problem of bucket and tool changing. These attachments are designed to aid in the handling of materials such as chunks of concrete, pipe, and logs, by providing a backup to the material being gripped by the curling action of the bucket. Some attachments also offer hydraulic control to the backup or clamping member to further help with the material handling.

Because of the similar mounting and operating action most of these attachments share, they tend to extend downward from the under side of the dipper boom excessively. This interferes with height clearance when working over obstacles such as high sided truck beds. Also, the material handling operation is so far off center of the dipper boom that it is difficult to operate in close quarter conditions, such as down in holes.

A further disadvantage of most known attachments is the absence of a horizontal edge on the attachments to work in cooperation with the teeth or edge of digging buckets. This edge is very important in handling many materials such as pipe or fence posts in vertical position, removing and handling sod, maneuvering and placing stone for rip-rap operations, and a wide variety of jobs that would be difficult without the horizontal edge.

SUMMARY OF THE INVENTION

In view of the disadvantages in the above paragraphs, it is an object of this invention to provide a better system to assist a digging bucket with material handling.

A material handling system is provided that is secured to the underneath side of a dipper boom. A modular arrangement of sliding bars, secured together side by side to match the bucket width, is mounted adjacent and parallel with the dipper boom. The sliding bars glide freely through guides and are operated by gravity. The low profile mounting of the sliding bars confines the protrusion of the system to within a few inches from the underside of the dipper boom and does not change.

The unique mounting of this system places the material being handled near the projected center line of the dipper boom. This allows the system and the digging bucket to work cooperatively down in holes or other close quarter operations. The mounting of this system also provides a better height clearance when working over obstacles such as high sided truck beds.

Other objects and advantages of a material handling system of sliding bars include:

(a) working in cooperation with a digging bucket while causing minimum interference with the bucket digging qualities;

(b) offering an immediate and continuous choice of digging or material handling operations;

(c) having a mounting independent of the digging bucket which will not interfere with bucket changing;

(d) having a simple low profile and self-aligning mounting system for the installation or removal of the system by one person in minutes;

(e) the system can be exchanged from one machine to another with any machine equipped with the easily installed mounting bracket;

(f) having sliding bars which have enough vertical travel to provide unrestricted bucket opening and can be stored in an uppermost position;

(g) providing modular sections of identical parts that are interchangeable;

(h) having a horizontally mounted edge at the lower end of the sliding bars that combines the strength of the bars and maintains alignment;

(i) having an angled bottom surface as part of the horizontally mounted alignment support assembly whereby the angled bottom surface provides lift to the bars during a digging operation so the digging pressure exerted to the angled bottom surface of the alignment support causes the support to raise over the path of the material entering the bucket and so that the support returns by gravity to retain the material in the bucket when digging pressure is relieved;

(j) having shock absorbing sleeves at the top of each sliding bar and which sleeves also have an off center retaining hole that can change the operating height of the alignment support;

(k) can be operated with no power lift but offers power lift options;

(l) offers an optional baffle capable of sealing the bucket opening for handling sand, mud, crushed stone, and other flowable materials;

(m) offers an optional alignment support assembly for the top of the sliding bars when it is necessary to operate with the lower support assembly removed so that materials such as scrap cable and wire can be handled with no obstacle at the bottom of the bars to get caught on; and (n) is universal in job use applications including interchangeable parts which greatly reduces the number of different parts needed to be carried in stock.

All that is needed to equip a machine with this system is the installation of a mounting bracket to the under side of the dipper boom. This is a simple job that requires only a measuring rule and a welder.

Considering their very mobile and adaptable nature, backhoes equipped with the system of the present invention could have life saving capability if they could be available when needed in a disaster area.

Further objects and advantages are to provide a material handling system that is equally of interest to all operations, whether it be farming, ranching, timbering or any of the many branches of industry. The interchangeable factor of the parts and systems from one machine to another can result in these systems being of universal nature.

Still further objects and advantages will become apparent from the following descriptions and drawings.

IN THE DRAWINGS

In the drawings, closely related figures have the same number but different alphabetic suffixes.

FIGS. 3A to 3D are side illustrational views of the sliding bars positioning during bucket loading.

Figure 4A:
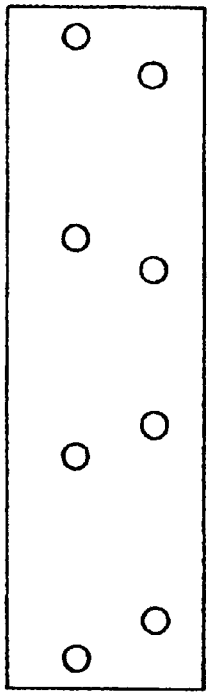
FIGS. 4A to 4D show a side, top, end, and top perspective view of a guide in accordance with the invention.
Figure 4B:
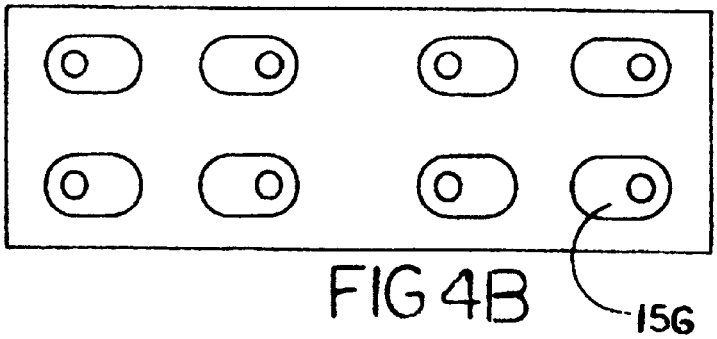
Figure 4C:
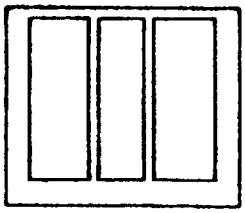
Figure 4D:
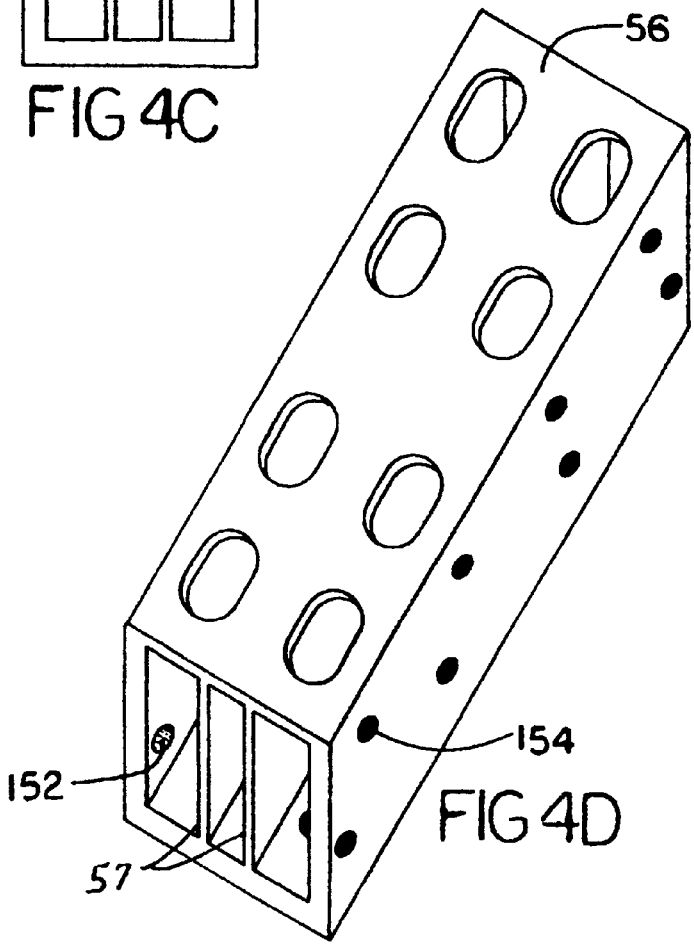
Figure 5:
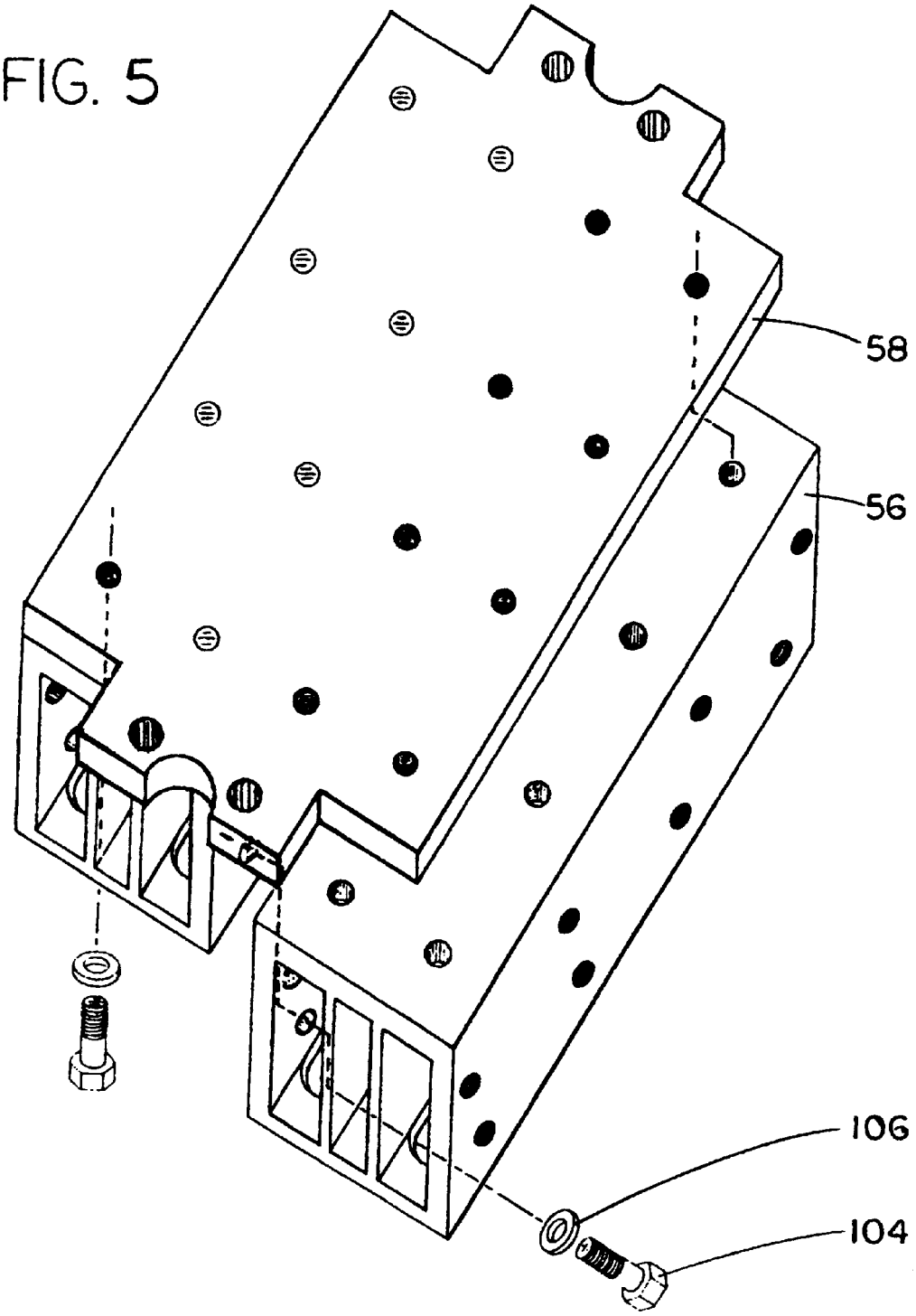

FIG. 5 in a partial assembly view showing a first guide of FIG. 4D installed to a backing plate and a second guide removed to illustrate hardware fastening.

Figures 6A, 6B:
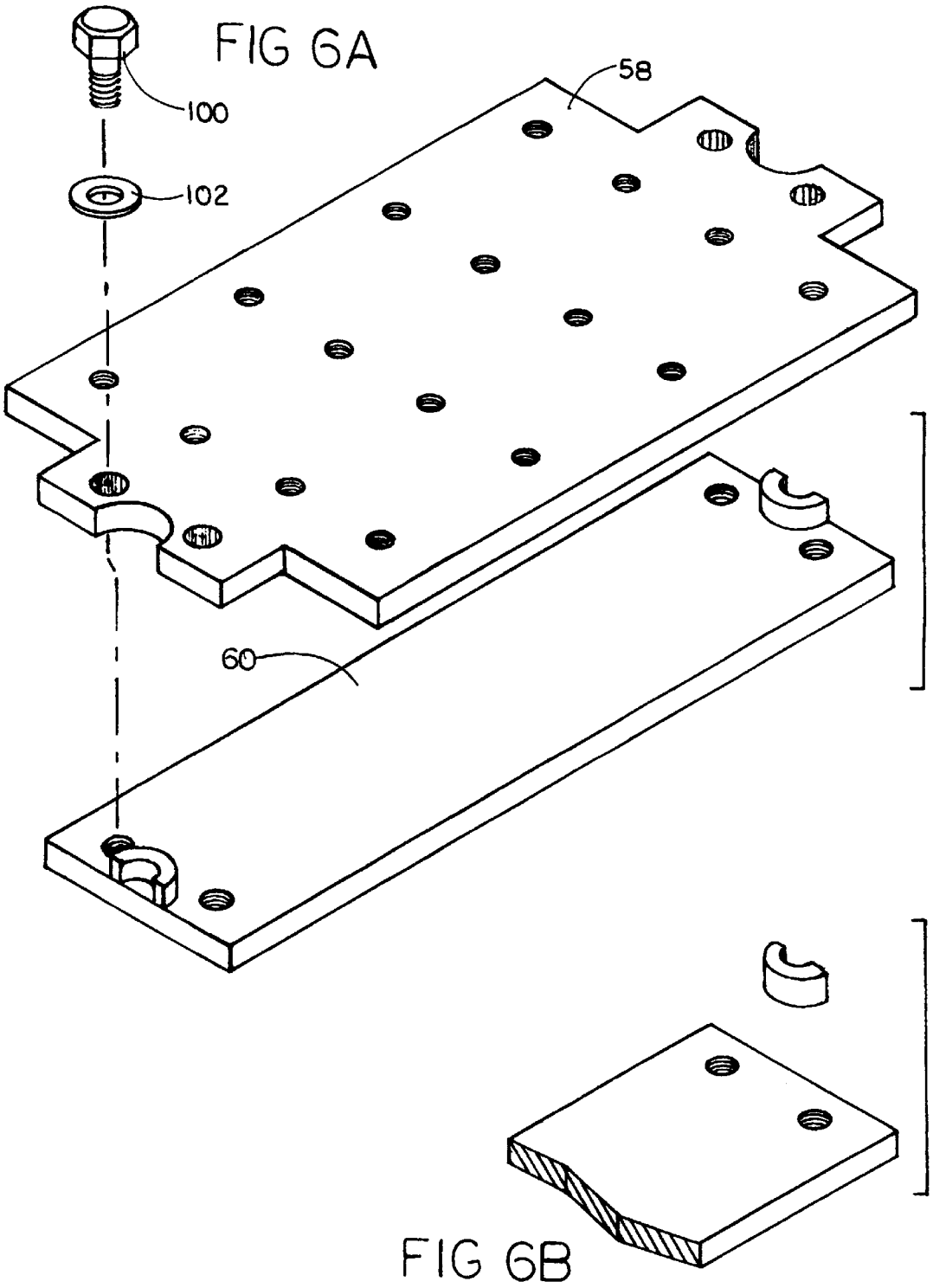

FIG. 6A is an assembly view of a backing plate and a mounting bracket to illustrate hardware fastening.

FIG. 6B shows an exploded assembly view of the self-aligning feature of the backing plate and mounting bracket of FIG. 6A.

Figure 7A:
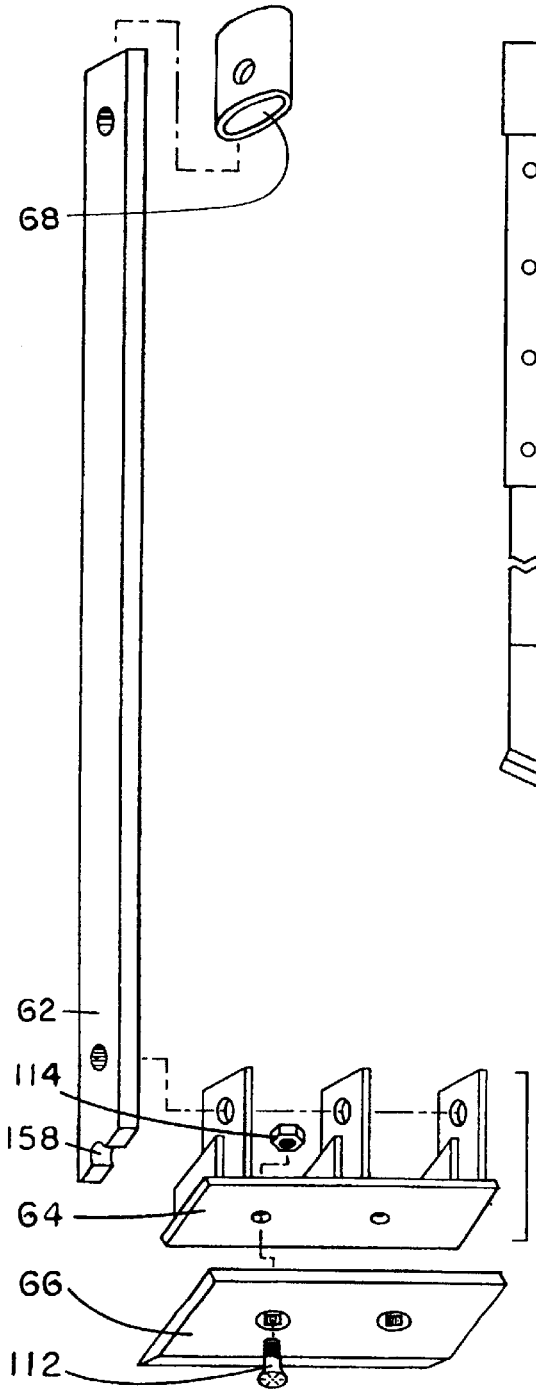

FIG. 7A is an assembly view showing a sliding bar with a shock absorbing and positioning sleeve at the top and an alignment support assembly at the bottom with an optional wear plate.

Figure 7B:
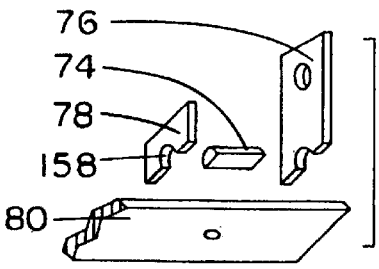

FIG. 7B shows an exploded view of a section of the alignment support assembly of FIG. 7A to illustrate a key.

Figure 8A:
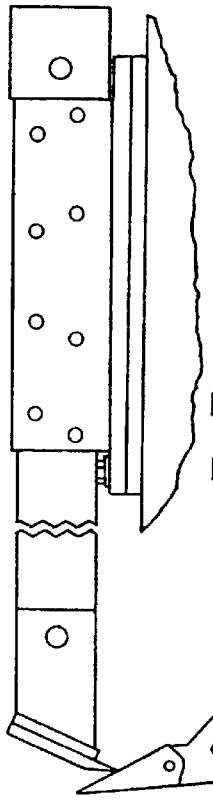
Figure 8B:
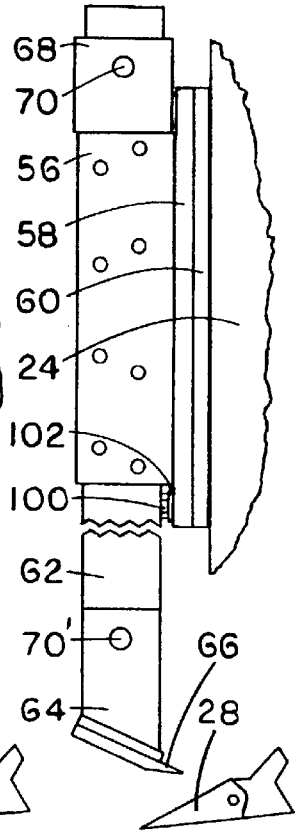

FIGS. 8A and 8B are side views of two guide and sliding bar assemblies to illustrate operating height adjustment.

Figure 9A:
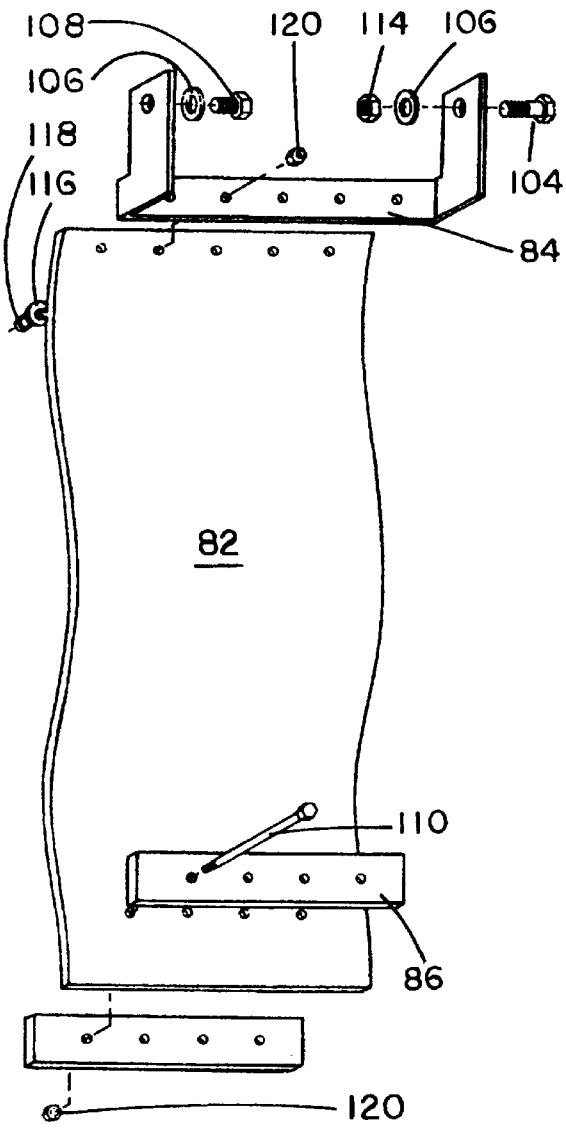

FIG. 9A is a rear perspective assembly view of an optional sand and mud baffle with mounting hardware.

Figure 9B:
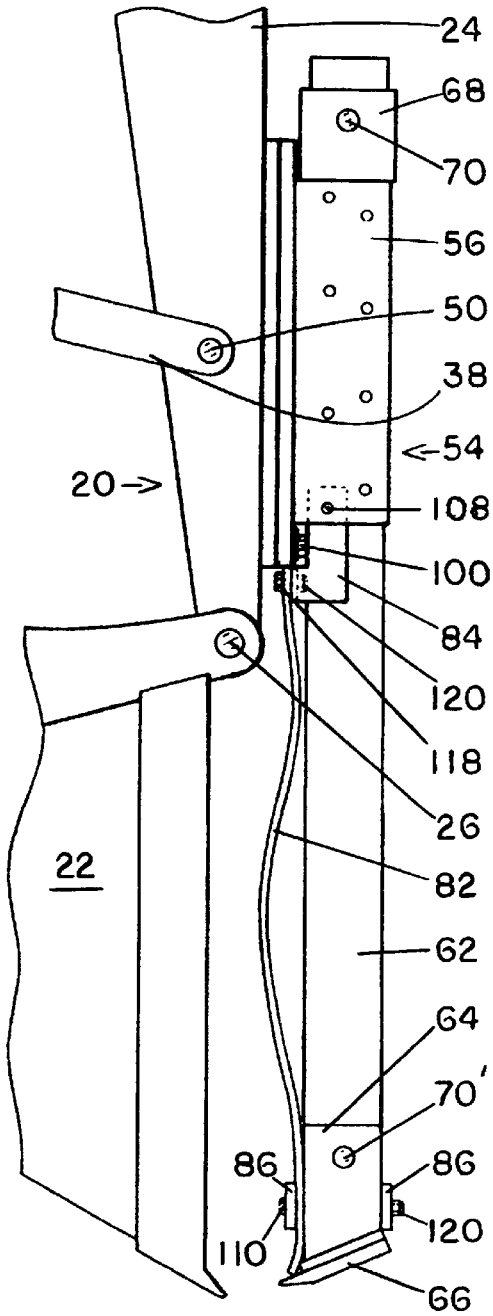

FIG. 9B is a side view of the baffle of FIG. 9A in operating position.

Figure 10:
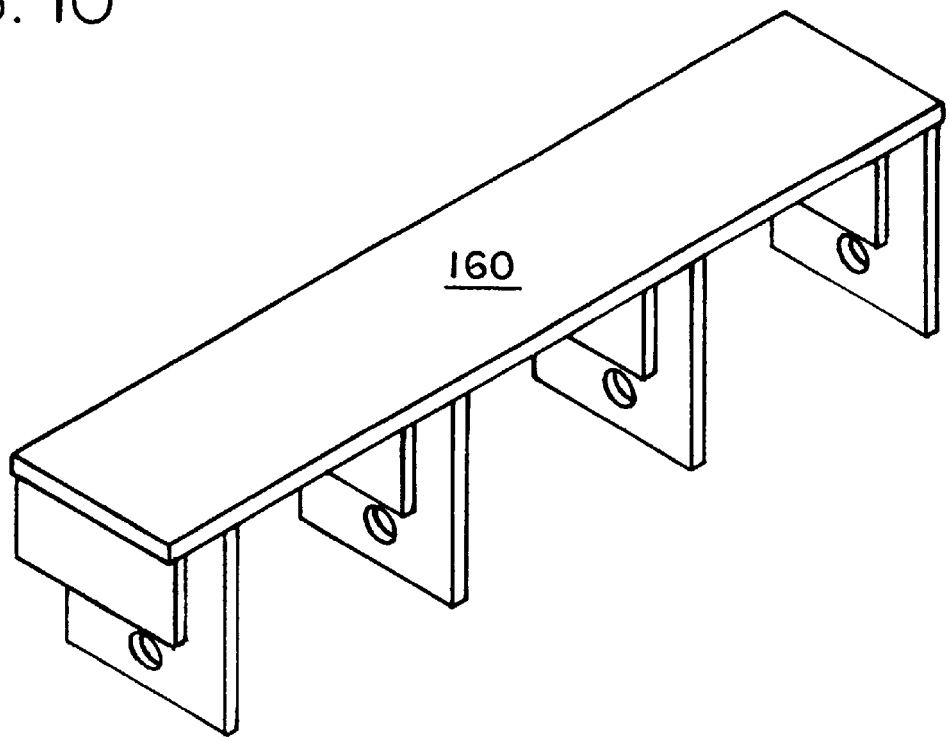

FIG. 10 is a top perspective view of an optional alignment support for the upper end of the sliding bars of the invention.

Figure 11:
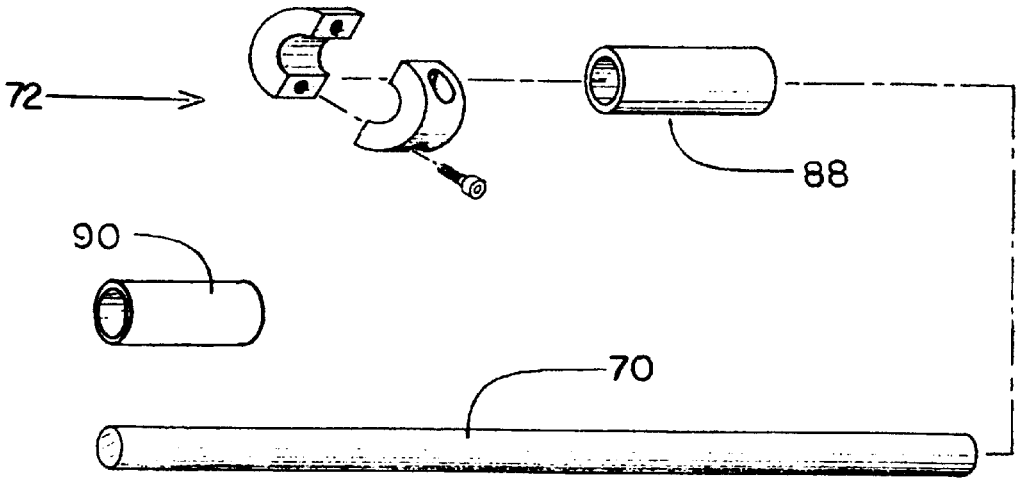

FIG. 11 is an assembly view showing the retaining hardware used on either end of the sliding bars.

Figure 12:
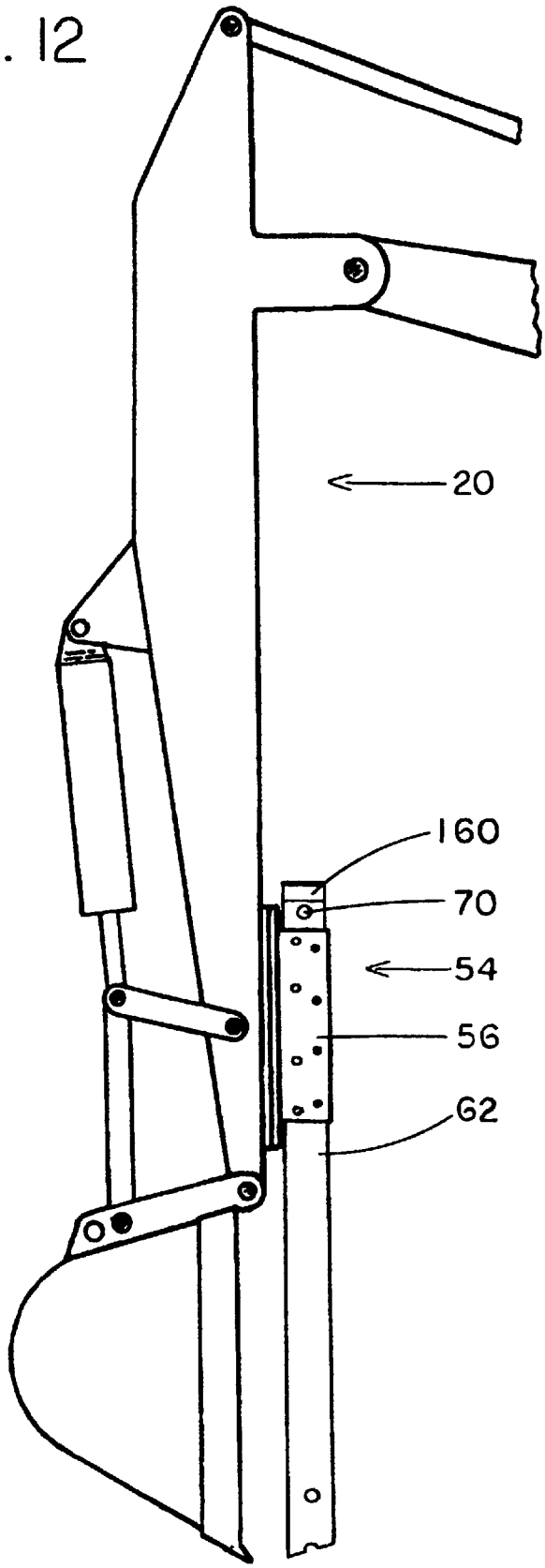

FIG. 12 is a side view showing the optional alignment support of FIG. 10 mounted on the system.

Figure 13A:
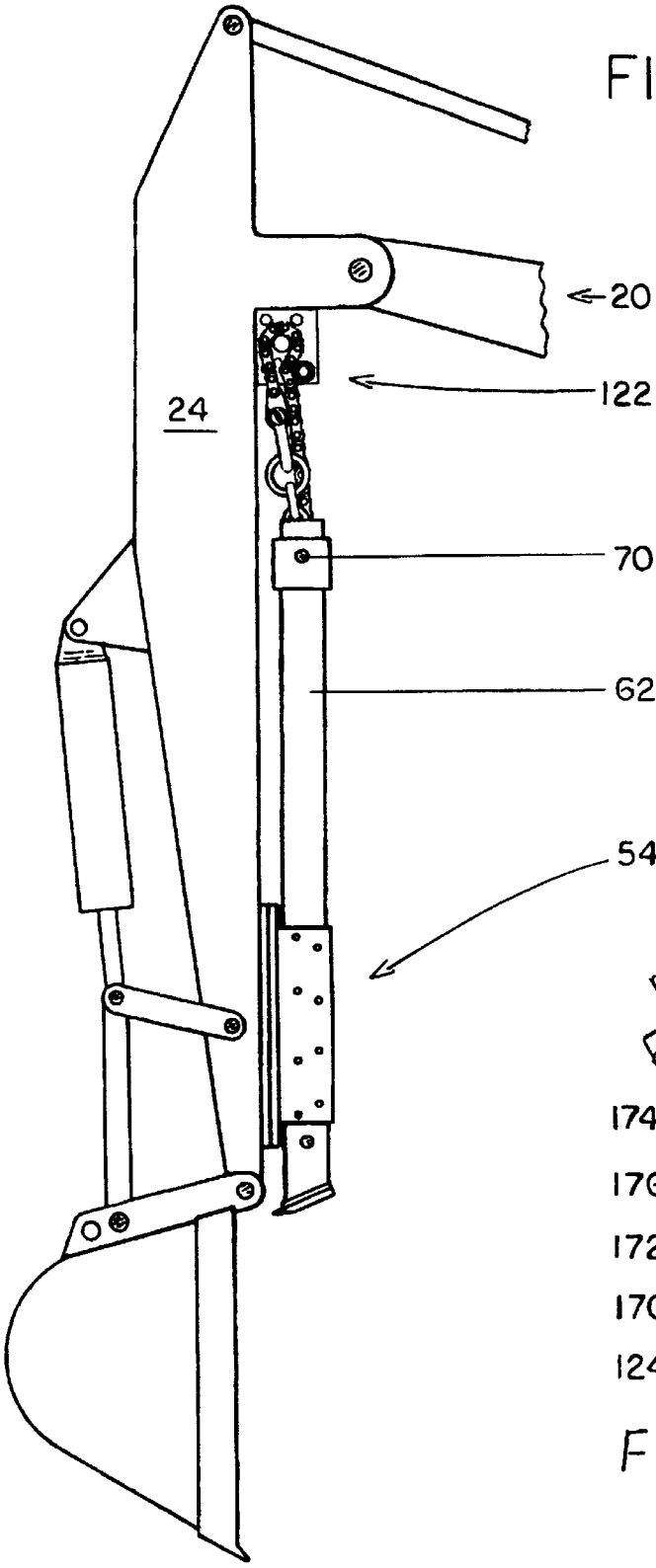

FIG. 13A is a side view of an optional power lift arrangement for moving the slide bars of the invention.

Figure 13B:
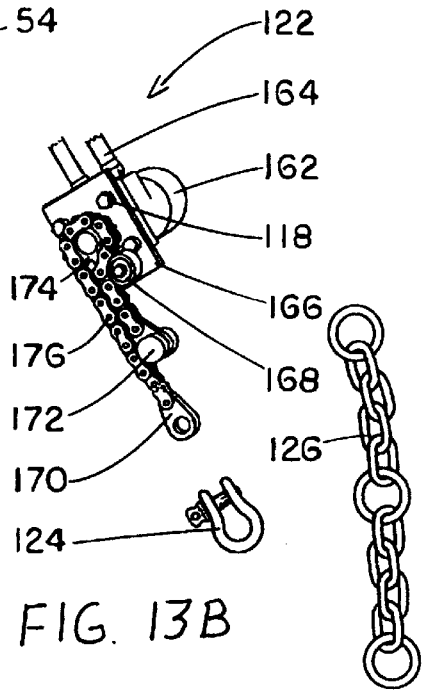

FIG. 13B is a perspective assembly view of the power lift of FIG. 13A.

Figure 14:
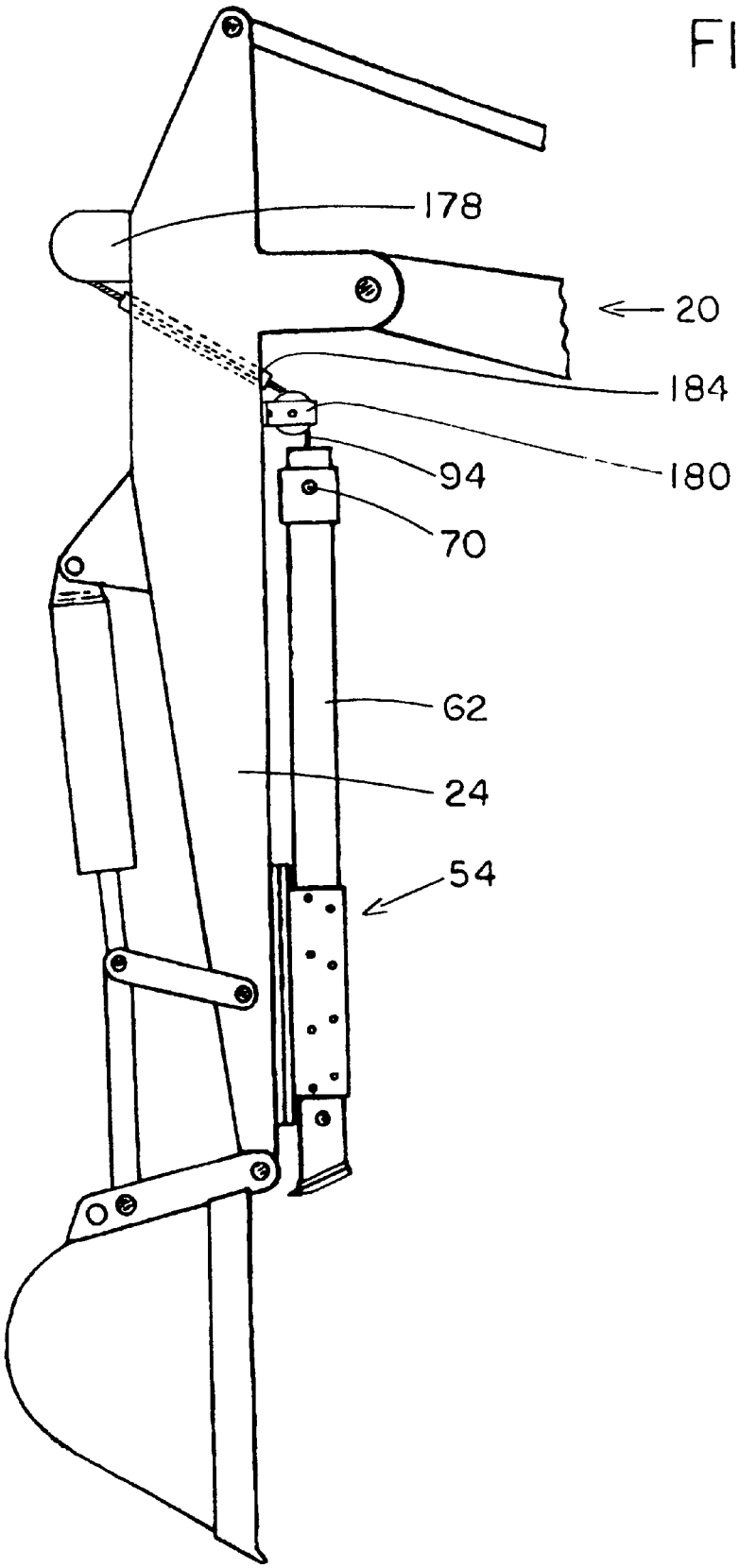

FIG. 14 is a side view of another optional power lift arrangement for moving the slide bars of the invention.

Figure 15A:
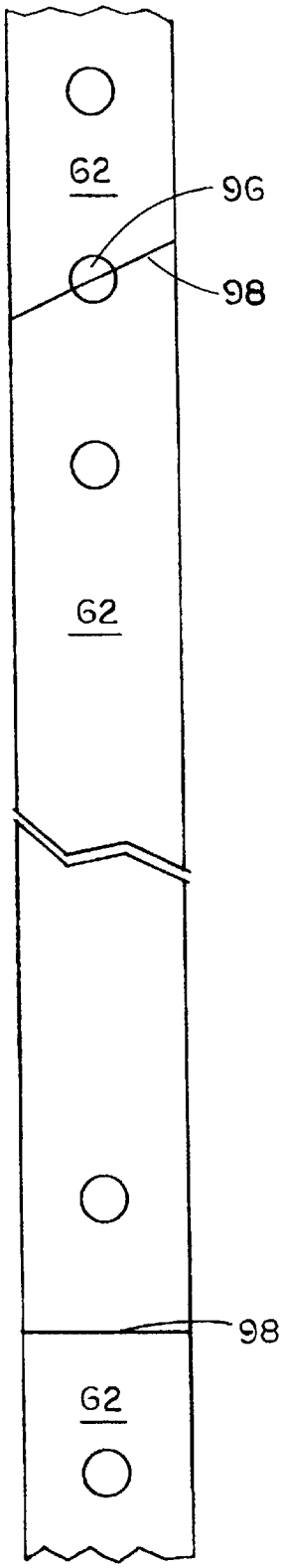
Figure 15B:
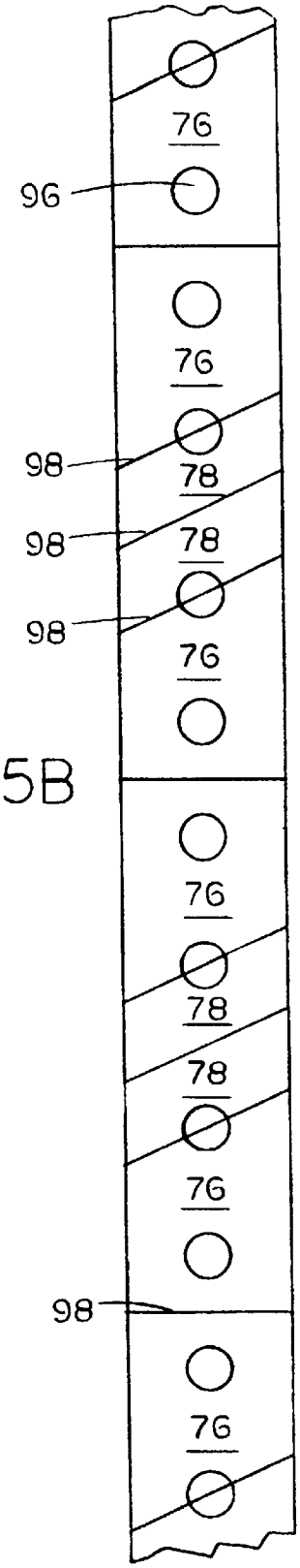

FIGS. 15A and 15B show lay off plans for parts cutting.

DESCRIPTION OF THE PREFERRED EMBODIMENTS

A system is provided to assist a powered digging machine with general material handling capability. The system can be used with or without power lift assistance, can be stored clear of a digging area, or can be quickly removed or installed as needed. The system can accomplish specialized duty when equipped with optional equipment illustrated and discussed hereinafter.

This invention is best understood by reference to the following description in conjunction with the drawings wherein like parts are designated by like numerals throughout.

Figure 1:
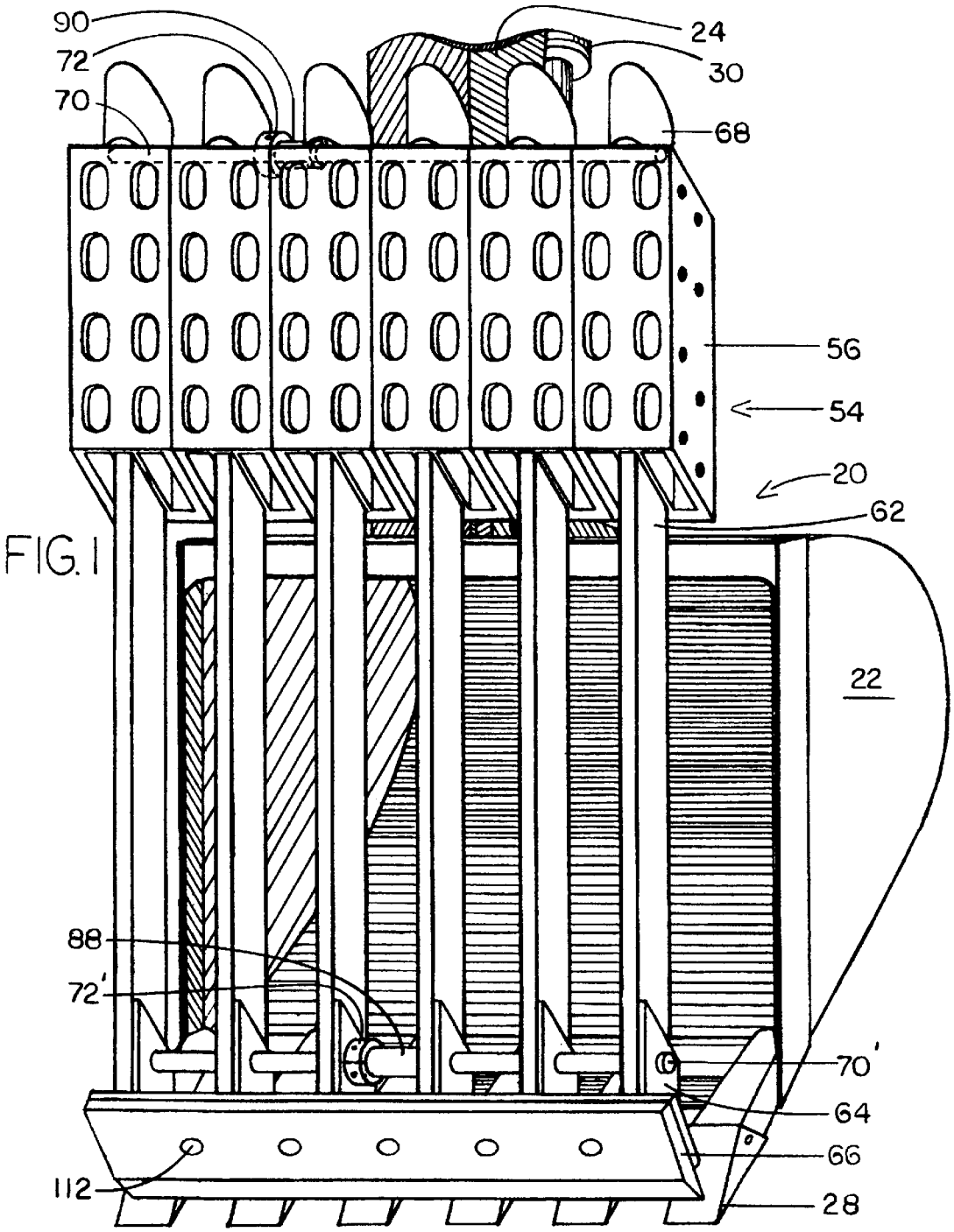
FIG. 1 shows a front perspective view of a six section sliding bar system of the invention mounted to a backhoe bucket and dipper boom assembly.
Figure 2:
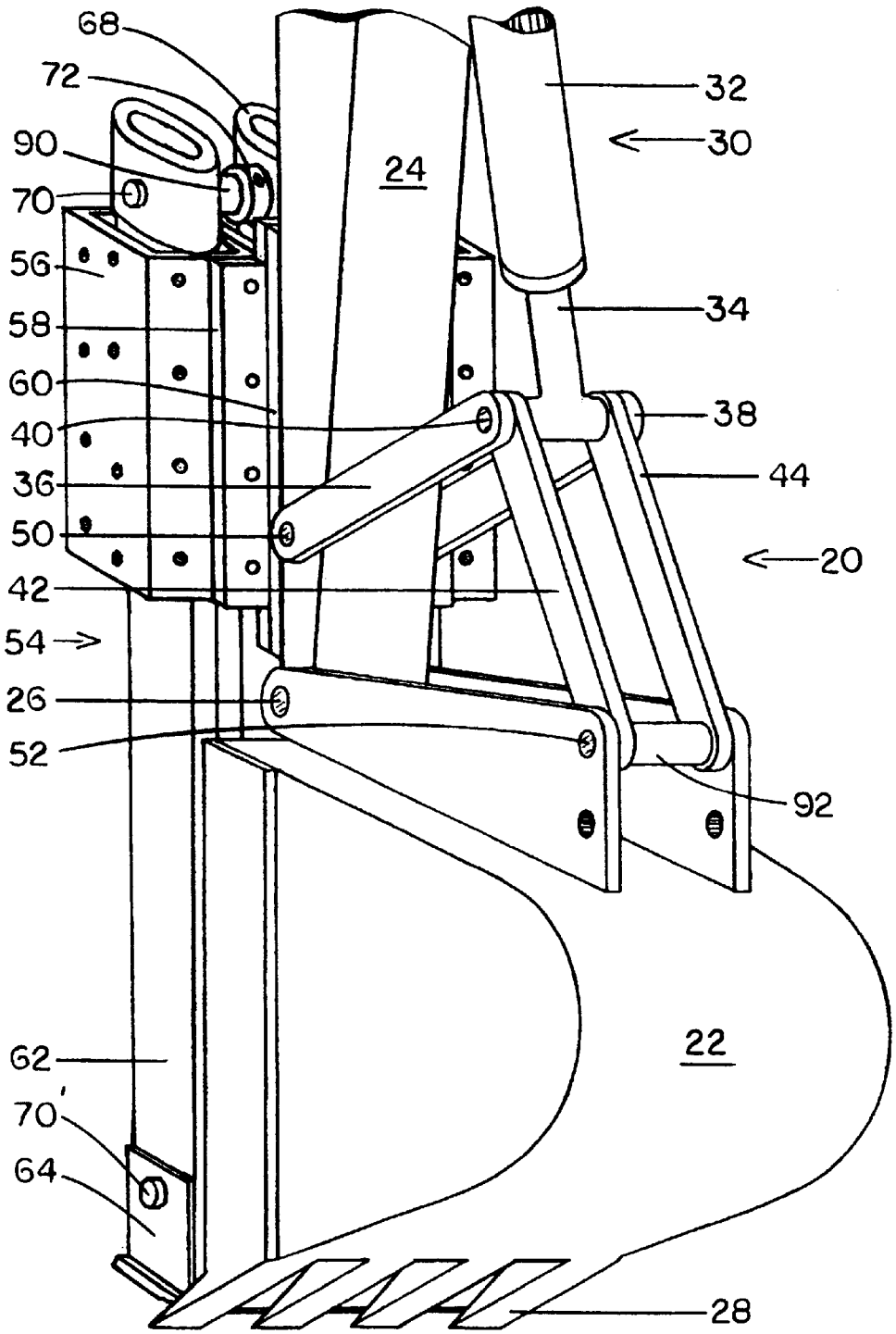
FIG. 2 shows a rear perspective view of a three section sliding bar system of the invention mounted to a backhoe bucket and dipper boom assembly.

Referring more particularly to FIG. 1, a conventional backhoe bucket and dipper boom assembly is shown generally at 20 and includes a backhoe bucket 22 mounted on the end of the dipper boom 24. The lower edge of the opening to bucket includes a set of digging teeth 28. As shown in FIG. 2, a hydraulic actuator 30 is mounted on the back of dipper boom 24 and is pivotally connected by link plates 36 and 38 and struts 42 and 44 to spaced flanges extending from the upper surface of the bucket 22.

FIG. 1 also shows the preferred embodiment of the invention at 54 mounted to bucket and boom assembly 20. A group of six guide elements 56 are secured together in a self supportive manner. The group of secured guide elements 56 are fastened to a backing plate 58, as shown in FIG. 2. The backing plate 58 is secured to a mounting bracket 60 that is fastened to the underside of dipper boom 24. A sliding bar 62 passes through each guide 56 and is retained by retaining shaft 70, spacer 90, and clamp or locking collar 72. The retaining shaft 70 also passes through and retains shock absorbing sleeves 68 that are placed at the top end of each bar 62. A horizontal alignment support assembly 64 is mounted to the lower end of bars 62 and is secured by retaining shaft 70', spacer 88, and locking collar or clamp 72'. An optional wear plate 66 is secured to support 64 with bolts 112. The manner in which the support assembly 64 is mounted to the bars 62 will be described hereinafter with reference to FIGS. 7A and 7B.

Referring now to FIG. 2, a rear perspective view of a backhoe bucket 22 and boom assembly is shown generally at 20. Also shown is the three section material handling system 54 secured to dipper boom 24 by means of backing plate 58 and mounting bracket 60.

Still referring to FIG. 2, the backhoe digging bucket 22 is shown pivotally mounted on the end of dipper boom 24 at pivot 26. The lower edge of bucket 22 includes a set of digging teeth 28. The hydraulic actuator 30 is pivotally mounted to an anchor (not shown) on the back of dipper 24 and includes cylinder 32 and piston rod 34. Piston rod 34 moves telecopically in and out of cylinder 32 in response to corresponding control movements of hydraulic controls (not shown) by an operator (not shown). Extension and retraction of piston rod 34 moves bucket 22 arcuately about pivot 26 to accomplish the desired movement of bucket 22. The end of piston rod 34 is pivotally engaged to the ends of link plates 36 and 38. Link plates 36 and 38 are rigidly interconnected by pin 40 in which piston rod 34 is pivotally engaged adjacent the mid point of pin 40. Struts 42 and 44 are pivotally mounted to pin 40 on each side of piston rod 34, respectively, and are also pivotally mounted to bucket 22 at pivot point 52. Link plates 36 and 38 are pivotally mounted on both sides of dipper 24 at pivot 50. Extension of piston rod 34 move the corresponding end of link plates 36 and 38 in a clockwise motion about pivot 50. Correspondingly, retraction of piston rod 34 moves the end of link plates 36 and 38 in counterclockwise motion about pivot 50. Arcuate movement along this circular path by the ends of struts 42 and 44 is translated into a corresponding arcuate movement of bucket 22 about pivot 26. Accordingly, bucket 22 can be opened rearward into a position where teeth 28 are parallel with dipper 24 or rotated forward to a point of close proximity to dipper 24. A spacer 92 at pivot 52 separate the ends of strut 42 and strut 44.

It is important to understand the corresponding movements of the previously described bucket control operation. The following operation section will further describe the cooperation of bucket 22 with system 54 to provide unique control characteristics.

Referring now more particularly to FIG. 3A, material handling system 54 is shown mounted to bucket and dipper boom assembly 20 which in turn is pivotally mounted to boom 150 at pivot 130 and pivot 138. The lower end of boom 150 is mounted at pivot 146 to powered vehicle 148. Hydraulic actuator 144 is attached to boom 150 at pivot 140 and pivotally anchored to vehicle 148.

Height and lifting control are accomplished for the digging operation by the telescopic control of piston rod 142 by actuator 144. Piston rod 142 retracts inward to raise boom 150 in response to corresponding movements of the hydraulic control (not shown) by the operator (not shown). Likewise, extension of piston rod 142 will cause the boom 150 to lower.

Dipper boom 24 control is accomplished by the extension and retraction of piston rod 134 in hydraulic actuator 136. The extension of piston rod 134 causes dipper 24 to move arcuately about pivot 130, which in turn causes bucket 22 to move inward toward vehicle 148.

Note especially that digging is accomplished more by the dipper 24 action than by the bucket 22 action, when equipped with this system.

Still referring to FIG. 3A, bucket 22 has been positioned by the telescopic control of piston rod 34 to provide an opening of a few inches between digging teeth 28 and alignment support 64. This opening is preferred to start the bucket loading cycle.

Referring now to FIG. 3B, assembly 20 with system 54 have been put into digging position. Digging action in FIG. 3B is accomplished by the extension of piston rod 134 to move bucket 22 toward vehicle 148 and corresponding control of piston rod 142 by the operator to maintain uniform digging depth. Digging pressure caused by bucket 22 being forced through the material toward vehicle 148 acts upon the bottom surface of support 64. This causes support 64 and bars 62 to move upward through guides 56. The extent to of the upward movement of bars 62 is made apparent by the space created between guides 56 and sleeves 68.

FIG. 3C shows an action that will let bars 62 and support 64 return to the lower position to retain the material when the bucket is full. When bucket 22 appears to be loaded, extension of piston rod 134 is halted just as piston rod 142 is retracted. This action causes bucket 22 to stop moving toward vehicle 148 and move upward. After only a small amount of upward movement of bucket 22, the bars will slide by gravity until sleeves 68 return to rest on top of guides 56 indicating the completion of the downward movement of bars 62. At this time, and preferably before the bucket leaves the digging area, piston rod 34 is extended to minimize the space between teeth 28 and support 64. There is no need to close bucket 22 toward support 64 with excessive pressure when loading loose material such as dirt.

In a preferred embodiment, the sleeves 68 are formed of a material which will exhibit shock absorbing characteristics when impacting the guides 56, such as a hard and durable rubber material. In some embodiment metal sleeves may be used.

FIG. 3D shows assembly 20 and system 54 with a full bucket 22 ready for loading to vehicle or other type deposit. The amount of space between teeth 28 and support 64 is telescopically controlled by piston rod 34 and ranges from fully closed (as shown in FIG. 3D) to fully open (not shown) dump position. This fully controllable feature allows the operator to deposit determined amounts of material to targeted areas with immediate shut off control or to make a fast dump deposit.

FIG. 4A shows a side view of one of the guides 56. Each guide 56 has an identical bolt hole pattern as to be reversible in nature. Although the sides of guide 56 have an identical hole pattern, one side of each guide 56 has threaded holes 154 while the other side has drilled holes 152. The first guide can be placed with threaded hole 154 on either side of guide 56 but all other guides 56 that are added, six in FIG. 1 and three in FIG. 2, must match direction of the first guide.

FIG. 4B shows a top view of a guide 56. The top side of guide 56 has access holes 156 to aid the installation of the mounting hardware (not shown).

FIG. 4C shows an end view of a guide 56. Note that the sides and bottom of guide 56 are of sufficient thickness to support bolt threads and to be generally self supportive when bolted together in sections.

FIG. 4D shows a top perspective view of a guide 56. The reversible feature of guide 56 is made apparent in this view.

FIG. 5 shows one guide 56 bolted to backing plate 58 and another guide 56 removed to illustrate hardware installation. Hardware to secure guide 56 to backing plate 58 includes capscrews 104 and washers 106 going directly through access holes 156 to the point of installation. Hardware to secure guide 56 together also includes capscrews 104 and washers 106 entering access hole 156, then making a right angle turn to point of installation.

Guides 56 can be mounted to the backing plate 58 split center, as shown in FIG. 5, or on center as shown in the three section application in FIG. 2. This choice of mounting allows a closer match to the bucket width when choosing the number of sections or elements needed. Each guide includes generally parallel inner guides walls 57 between which a bar 62 is slidably retained.

Backing plate 58 shown in FIG. 5 can be used on a narrow digging bucket, yet offers adequate support to a much wider application. If a narrow bucket application will not be used, backing plate 58 can be provided in any width desired.

FIG. 6A shows backing plate 58 separated from mounting bracket 60 to illustrate the self-aligning feature and hardware fastening. The alignment feature includes arcuate notches 58A formed in plate 58 and in arcuate sleeves 60A formed in bracket 60. FIG. 6B shows an exploded view of the self-aligning feature of bracket 60.

Still referring to FIGS. 6A and 6B, mounting bracket 60, as shown, is of sufficient thickness to support bolt threads. A much lighter mounting bracket could be used if threaded blocks or nuts were fastened to the back of the thinner plate and allowed to protrude into dipper boom 24 with provided access.

Referring now to FIG. 7A, a sliding bar is shown at 62. At the lower end of bar 62, the alignment support assembly 64 is shown separated from bar 62. Wear plate 66 is shown separated from support 64 and includes bolt 112 and nut 114. Also shown in FIG. 7A is shock absorbing and positioning sleeve 68.

FIG. 7B shows an exploded view of support 64. This view is necessary to illustrate a key 74. Each bar 62 is mounted to shaft 70' adjacent a bracket 76 extending from a plate 80. The bar is positional between the bracket 76 and a spaced flange 78. The key 74 self aligns the parts involved by fitting in notches 158 provided at the bottom end of the bars 62 and the brackets 76 and flanges 78.

FIG. 8A shows a shortened side view of a bar 62 installed in guide 56. Sleeve 68, having an off center retaining hole, is installed on the top end of bar 62 so as to allow bar 62 to operate in a low position. Retaining shaft 70 passes through sleeve 68 and bar 62 to retain both parts. Guide 56 is secured to backing plate 58 which is secured to mounting bracket 60 by capscrews 100 and washers 102. Mounting bracket 60 has been welded to dipper boom 24 at a location that allows wear plate 66 (if used) to contact digging tooth 28 when sleeve 68 is resting on guide 56 in the low operating position, as shown in FIG. 8A.

FIG. 8B shows sleeve 68 installed for bars 62 to operate in a high position. In this position, the shaft 70 elevates the bar 62 and the hole in the sleeve 68 is higher because the sleeve is reversed. This height allows support 64 to enter the bucket with minimum tooth contact. This feature will be further described with respect to FIG. 9B.

FIG. 9A shows a baffle at 82 for handling of materials such as sand, crushed stone, mud, and liquids. Also shown in FIG. 9A are items of hardware necessary to mount baffle 82 to system 54.

FIG. 9B shows baffle 82 installed to system 54. Bracket 84 is secured to guide 56 with capscrew 104, capscrew 108, washers 106 and nut 114. Baffle 82 is secured to bracket 84 with bolts 118, washers 116, and nuts 120. The lower end of baffle 82 is secured to support 64 with plates 86, bolts 110, and nuts 120.

The preferred embodiment of this optional feature as shown in FIG. 9B shows sleeve 68 installed on bar 62 to operate in a high position. Bucket 22 is shown with no teeth. This arrangement offers better sealing possibilities at the bucket entrance with the absence of teeth 28.

Baffle 82 is generally a flexible material that can be easily altered. By trimming baffle 82 to fit the bucket opening, a good seal can be obtained. Most buckets 22 have tapered bottom and sides offering a tighter seal as baffle 82 enters further into bucket 22.

Even with teeth 28 installed on bucket 22, a satisfactory seal can be obtained with baffle 82 for handling most flowable materials.

The rubber like material of baffle 82 can be substituted with heat resistant material such as linked material fabric. This could enable a machine equipped with system 54 and the baffle arrangement in FIG. 9A and FIG. 9B to handle hot slag or other hot materials.

Still referring to FIG. 9B, bucket 22 is positioned to the tip of dipper 24 by the offset bucket mounting at pivot 26. A bucket that has the mounting hole at pivot 26 positioned over the bucket rather than offset as in FIG. 9B may be more suitable for some baffle equipped operations.

FIG. 10 shows an optional alignment support 160 that can be installed to the upper end of bars 62. Sleeves 68 must be removed to install support 160. Retaining shaft 70, spacer 88, and clamp assembly 72 are used to secure support 160. Materials such as scrap cable and wire can become tangled with lower support 64. With support 160 in place to maintain support and alignment to bars 62, support 64 can be removed, leaving the lower end of bars 62 bare.

FIG. 11 shows retaining hardware used at each end of bars 62. Shaft 70, spacer 88, and clamp 72 are used to retain support 64 or support 160. To retain sleeves 68, shaft 70, spacer 90, and clamp 72 are used.

FIG. 12 shows a side view of system 54 mounted to assembly 20 with support 160 mounted to the upper end of bars 62.

FIG. 13A shows a side view of system 54 mounted to assembly 20 with an optional power lift installed at 122. As shown in FIG. 13B, this preferred arrangement consists of a hydraulic motor 162 secured to mounting plate 166 with bolts 118, sprocket 174, roller chain 176, end 170, and stop 172. Hoses 164 are installed to hydraulic controls (not shown). Movements of the hydraulic controls by an operator causes sprocket 174 to correspondingly rotate in the desired direction to provide up or down movement of roller chain 176. Clevis 124 connects end 170 to the middle ring of chain 126. Shaft 70 connects to the end rings of chain 126.

The installation of power lift 122 offers the operator an immediate choice of using system 54 or storing to their upper limit the bar 62. This can save time removing and installing system 54 when full bucket freedom is needed.

FIG. 14 shows a side view of system 54 mounted to assembly 20. Also shown are a small group of parts that can allow a power lift to be installed on machines with limited available space beneath dipper 24. This illustration shows winch 178 mounted to the outside top of dipper 24. A tube 184 has been inserted through dipper 24 and welded in place. Guide roller 180 is 5 bolted or welded beneath dipper 24 near the end of tube 184. Cable 94 is routed from winch 178 through tube 184, over roller or pulley 180, then connected to system 54 at shaft 70 by thimble-clamp and clevis.

The parts shown in FIG. 14 can be arranged in many locations and angles to allow for the installation of a power lift arrangement to dipper 24 even with limited space. Power lift 122 can be used in place of winch 178 or many other available lifting devices. Any available power can be used including compressed air and electric.

FIG. 15A and FIG. 15B show a parts layout plan for making holes and cutting parts from manufacturing stock material.

FIG. 15A shows the layout for cutting a bar 62 as shown in FIG. 7A. Holes 96 are made first, then cuts are made at 98.

There is no material waste and key notch 158 as shown in FIG. 7A is complete.

FIG. 15B shows the layout for cutting a bracket 76 and bracket 78 shown in FIG. 7B. Holes 96 are made first, then cuts 98 are made. Bracket 76 and bracket 78 are complete with notch 158 as shown in FIG. 7B.

An example of an option of the invention would be to install a lubricating system to guides 56. A light lubricating material that retains minimum dust could be used.

A pressure control system for the bucket control circuit may be important addition to the system when handling crushable materials such as wood or plastic. Controls should be within easy reach of an operator and offer full range of immediate service.

In use, this system is subject to extreme environment and pressure. A tough bend resistant steel, such as T1 should be used to build most of this system. A high quality ground engaging type steel should be used to make the bars.

The present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes which come within the meaning and range of equivalency of the claims are to be embraced within their scope.

What is claimed is:

1. An implement for use in retaining material within a bucket pivotally mounted to a vertically adjustable boom of an earth working machine, the implement including, a guide means having open upper and lower ends, means adapted to mount said guide means to the boom in a predetermined spaced relationship relative to an opening of the bucket, at least one bar slidably movable within said guide means and having upper and lower end portions, said at least one bar being movable by gravity from a first position wherein said lower end thereof is positioned relative adjacent said lower end of said guide means to a second position wherein said lower end is spaced from said lower end of said guide means such that at least one bar is adapted to extend at least substantially across and in opposing relationship to the opening of the bucket to thereby facilitate retention of material within the bucket, and means for retaining said at least one bar within said guide means when at least one bar is in said second position in such that said at least one bar is free to move from said second position to said first position by a force supplied along an elongated axis of said at least one bar.

2. The implement of claim 1 wherein said means for retaining includes a sleeve disposed about said upper end portion of said at least one bar and a retaining shaft extending through aligned openings in said at least one bar and said sleeve.

3. The implement of claim 1 including a plurality of bars movably mounted within said guide means in space relationship with respect to one another and said means for retaining including means for securing said upper end portions of each of said bars in generally a fixed relationship with respect to one another.

4. The implement of claim 3 wherein said means for retaining each said upper end portions of said bars includes means for retaining said upper end portions of said bars in at least two positions relative to said upper end of said guide means when said bars are in said second position.

5. The implement of claim 4 wherein said means for retaining said upper end portions of said bars in at least two positions relative to said upper end of said guide means includes a plurality of sleeves, each of said sleeves having aligned openings therein which are offset between upper and lower ends thereof, each of said upper end portions of said bars having an opening therein and being receivable between said sleeves such that said openings in said bars are aligned with said openings in said sleeves, and a retaining shaft extending through said openings in said sleeves and said bars for retaining said bars within said sleeves.

6. The implement of claim 3 including a support assembly mounted to said lower end portion of said bars for retaining said lower end portions of said bars in generally fixed relationship with respect to one another.

7. The implement of claim 6 in which said support assembly includes an elongated plate having a plurality of space brackets extending therefrom, each said brackets including an opening therein, each of said lower end portions of said bars including an opening therein, and a retaining shaft extending through said openings in said lower portions of said bars and said brackets.

8. The implement of claim 7 including an elongated wear plate mounted to said elongated plate of said support assembly.

9. The implement of claim 3 in which guide means includes a plurality of guide elements, means for securing each of said plurality of guide elements in side-by-side relationship with respect to one another, a mounting bracket adapted to be secured to the boom, and means for securing said plurality of guide elements to said mounting bracket.

10. The implement of claim 9 in which each of said guide elements includes an enclosed housing having a pair of generally parallel guide walls disposed therein in spaced relationship with respect to one another, said bars being slidable disposed between said guide walls.

11. The implement of claim 3 including power lift means adapted to be mounted to the boom and connected to said bars for selectively moving said bars from said second position to said first position.

12. The implement of claim 11 in which said power lift means includes a motor adapted to be mounted to the boom and link means connecting the motor to said bars.

13. The implement of claim 11 in which said power lift means includes a winch adapted to be mounted to the boom and link means extending from said winch to said bars.

14. The implement of claim 3 including a baffle, and means for mounting said baffle along said bars so as to be in generally covering relationship with respect to the opening in the bucket when said bars are in said second position.

15. The implement of claim 14 in which said baffle is generally flexible, and first means for securing said baffle to said guide means and second means for securing said baffle to said lower end portion of said bars.

* * * * *